US005326336A

United States Patent [19]

Wemlinger

[11] Patent Number: 5,326,336

[45] Date of Patent: Jul. 5, 1994

[54] DIVING BOARD LIFT

[76] Inventor: Fredric Wemlinger, 5300 60th Street SW., St. Cloud, Minn. 56304

[21] Appl. No.: 15,565

[22] Filed: Feb. 9, 1993

[51] Int. Cl.[5] ..... A63B 5/10

[52] U.S. Cl. ..... 482/30; 482/31; 254/3 R

[58] Field of Search ..... 52/86, 169.7, 261, 250, 52/245, 729; 55/188; 4/490; 482/30, 31, 32; 254/3 R, 3 B, 3 C, 124; 14/31, 33, 42, 36; 108/357; D21/236; D25/2; D34/31

[56] References Cited

U.S. PATENT DOCUMENTS

| | | | |
|---|---|---|---|
| 149,255 | 3/1874 | Semmendinger | 108/7 |
| D. 235,751 | 7/1975 | Butorac | D31/31 |
| 2,011,627 | 8/1935 | Graham | 254/3 C |
| 2,212,460 | 8/1940 | Stephenson | 482/31 |
| 2,355,341 | 8/1944 | Trimbach | 254/3 R |
| 3,376,795 | 4/1968 | Allen | 14/36 |
| 3,450,404 | 6/1969 | Nightingale | 482/31 |
| 4,858,888 | 8/1989 | Cruz et al. | D34/31 |
| 4,998,718 | 3/1991 | Arens | 482/30 |
| 5,131,333 | 7/1992 | Karasawa et al. | 108/7 |
| 5,205,010 | 4/1993 | Hageman | 14/31 |

*Primary Examiner*—Richard J. Apley
*Assistant Examiner*—Jerome Donnelly
*Attorney, Agent, or Firm*—Kinney & Lange

[57] ABSTRACT

A diving board lift assembly for lifting a diving board from a substantially horizontal diving position to a substantially upright position is provided. The diving board having a diving end and a hinged end with the hinged end hingedly connected to a diving board support member. In accordance with the present invention, a lifting mechanism is provided to lift the diving end of the diving board to the substantially upright position.

9 Claims, 3 Drawing Sheets

DIVING BOARD LIFT

BACKGROUND OF THE INVENTION

The present invention relates to diving board systems used in connection with swimming pools; in particular, it relates to a lifting mechanism for a diving board to move the diving board from a substantially horizontal diving position to a substantially upright position.

Diving board systems generally include a diving board having a diving end and a secured end with the diving board being hingedly fastened to an anchored support at the secured end. The diving end is preferably positioned adjacent the edge of or over a swimming pool or area. An intermediate support is placed beneath the diving board between the diving end and the anchored end to act as a fulcrum point thereby allowing vertical movement of the diving end. Such vertical movement allows the diver to "spring" into the air to attempt or complete the diver's dive.

Placement of the diving board is critical in that locating a diving board over an area of the swimming pool which is too shallow could result in severe bodily injury to the diver. Therefore, diving boards in many swimming pools are generally located at or near the deepest end of the swimming pool.

In many situations, swimming pools are used for additional activities besides recreational swimming and diving. One of these additional activities includes swim racing. Sometimes it is possible to locate diving boards away from the area of swimming pools in which swimming races are conducted thereby allowing diving activities and swim racing to continue in different areas simultaneously.

While positioning diving boards away from the swim racing area allows more activities to be scheduled at one swimming pool at the same time, due to space and budget constraints, many swimming pool operators must place the diving boards in an area which also must be used for swim racing. Additionally, in many swim races, especially those which require a swim racer to begin the race facing the water, the use of racing starting platforms is required. Racing starting platforms are generally positioned at the edge of the swimming pool and include a stage which is elevated approximately two to three feet above the water level. At the beginning of the race, the swim racer stands on the stage until a starting signal is sounded to indicate the beginning of the race. When the signal sounds, the swim racer begins the swim race by diving into the swimming pool.

Poolside placement of the racing starting platform is generally regulated by municipalities and other local government entities which operate or govern the swimming pools. These regulations generally require that racing starting platforms be located at or near the deepest end of the swimming pool; the same area as the location of the diving boards. Therefore, in order to position the racing starting platforms at the same end of the swimming pool as the diving boards, the diving boards must be either removed or the diving end of the diving board must be manually raised to a position which does not conflict with the positioning of the racing starting platform.

Physically removing the diving board from its support requires extensive time and labor. Likewise, manually lifting a diving board requires several persons, due to the weight of the diving board, to position themselves at the edge of the pool and to lift the diving end of the diving board upward. The precarious location near the edge of the swimming pool, usually being wet and somewhat slippery, requires that the persons lifting the diving board be extremely careful. In addition, most diving boards extend over the swimming pool thereby requiring the persons lifting the board to position themselves adjacent the approximate center of the diving board rather than directly at the diving end where lifting a hinged object such as a diving board would be more appropriate.

As the persons lift the diving board, the diving end of the diving board travels upward, the persons lifting must continue to move their hands down the diving board. Once the diving board is substantially vertical, the persons lifting the diving board must now manipulate the diving board down over the top to a position away from the edge of the swimming pool such that the anchored support is between the diving board and the swimming pool. Here, the diving board either must lean against a wall or lay on the flooring surrounding the swimming pool.

Lifting and maneuvering a diving board in the above-discussed fashion is strenuous and physically difficult. Injuries are common due to the awkward and compromising positions the persons lifting the diving board must assume. Additionally, once the diving board has been lifted, its resting position against a wall or on the floor is extremely dangerous since a person could strike or trip over the diving board thereby causing potentially severe injuries.

SUMMARY OF THE INVENTION

The present invention is a diving board lift for raising a diving board from a substantially horizontal diving position to a substantially upright position. The diving board has a diving end and a hinged end, the hinged end being connected to an anchored support.

The diving board lift according to the present invention comprises a frame secured to the anchored support. A lifting platform having a first end and a second end is hingedly secured to the frame at the first end and extends away from the anchored support under and substantially parallel to the diving board. The second end of the platform is pivotable to engage the diving board.

Lifting means hingedly connected to the frame and the second end of the platform for raising the platform into engagement with the diving board and for lifting the end of the diving board to the substantially upright position are provided.

In a preferred embodiment, the diving board includes an underside and, upon lifting of the platform, the second end of the platform engages the underside of the diving board. Additionally, the second end of the platform can include at least one roller with each roller contacting and rolling along the underside of the diving board while the diving board is raised to the substantially upright position.

DETAILED DESCRIPTION OF THE PREFERRED EMBODIMENTS

Figure 1:
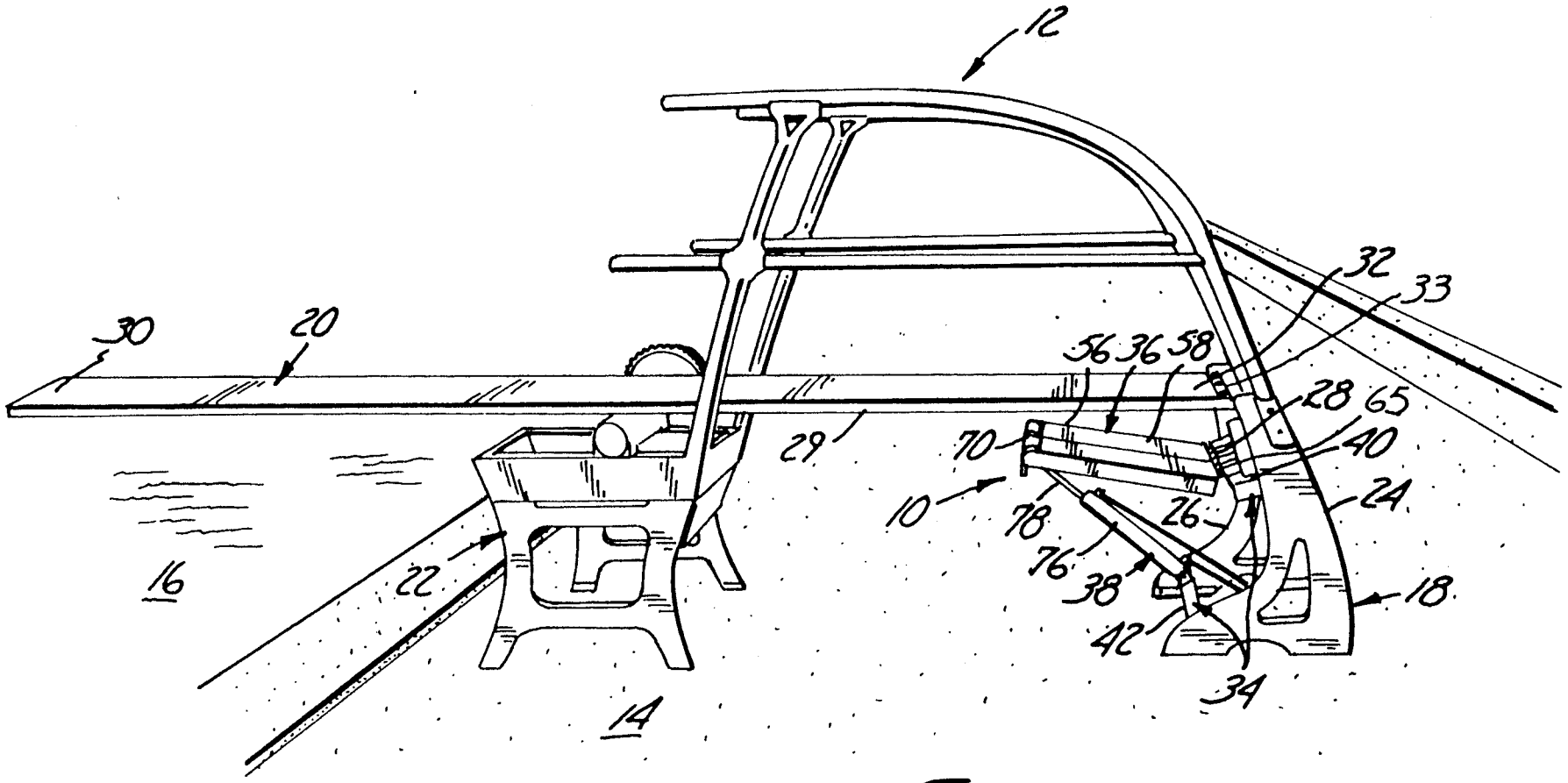
FIG. 1 illustrates a perspective view of a diving board lift assembly in accordance with the present invention with the diving board in a diving position.

FIG. 1 illustrates a perspective view of a diving board lift assembly, designated generally at 10, for use with a diving board system 12 supported by a floor 14 surrounding a swimming area or pool 16. The diving board system 12 includes an anchored support 18, a diving board 20 and an intermediate support 22. The anchored support 18 can be of any preferred design or construction. In the embodiment illustrated in FIG. 1, the anchored support 18 includes a pair of parallel leg members 24, 26 anchored to the floor 14. A cross member 28 is secured between the leg members 24, 26 such that the cross member 28 is substantially perpendicular to the both leg members 24, 26.

The diving board 20 is constructed of known materials and includes an underside 29, a diving end 30 and a supported end 32. The supported end 32 is hingedly attached by a hinge 33 to the cross member 28 between the leg members 24, 26 of the anchored support 18. The diving board 20 extends toward the swimming pool 16 such that a person using the diving board 20 can jump or leap from the diving board 20 directly into the swimming pool 16.

The intermediate support 22 can also be of any preferred design or construction and is positioned beneath the diving board 20 between the anchored support 18 and the swimming pool 16. With many diving board systems, the intermediate support 22 supports the diving board 20 such that the diving board 20 rests upon the intermediate support 22 in a substantially horizontal fashion. The intermediate support 22 acts as a fulcrum point allowing up and down vertical movement of the diving end 30 of the diving board 20 during diving.

The diving board lift assembly 10 includes a frame 34, a lifting platform 36 and a cylinder 38. The cylinder 38 could be a hydraulic cylinder, a pneumatic cylinder or screw mechanism, or mechanical lever device. However, for purposes of describing the present invention, the cylinder will be referred to as a hydraulic cylinder.

Figure 2:
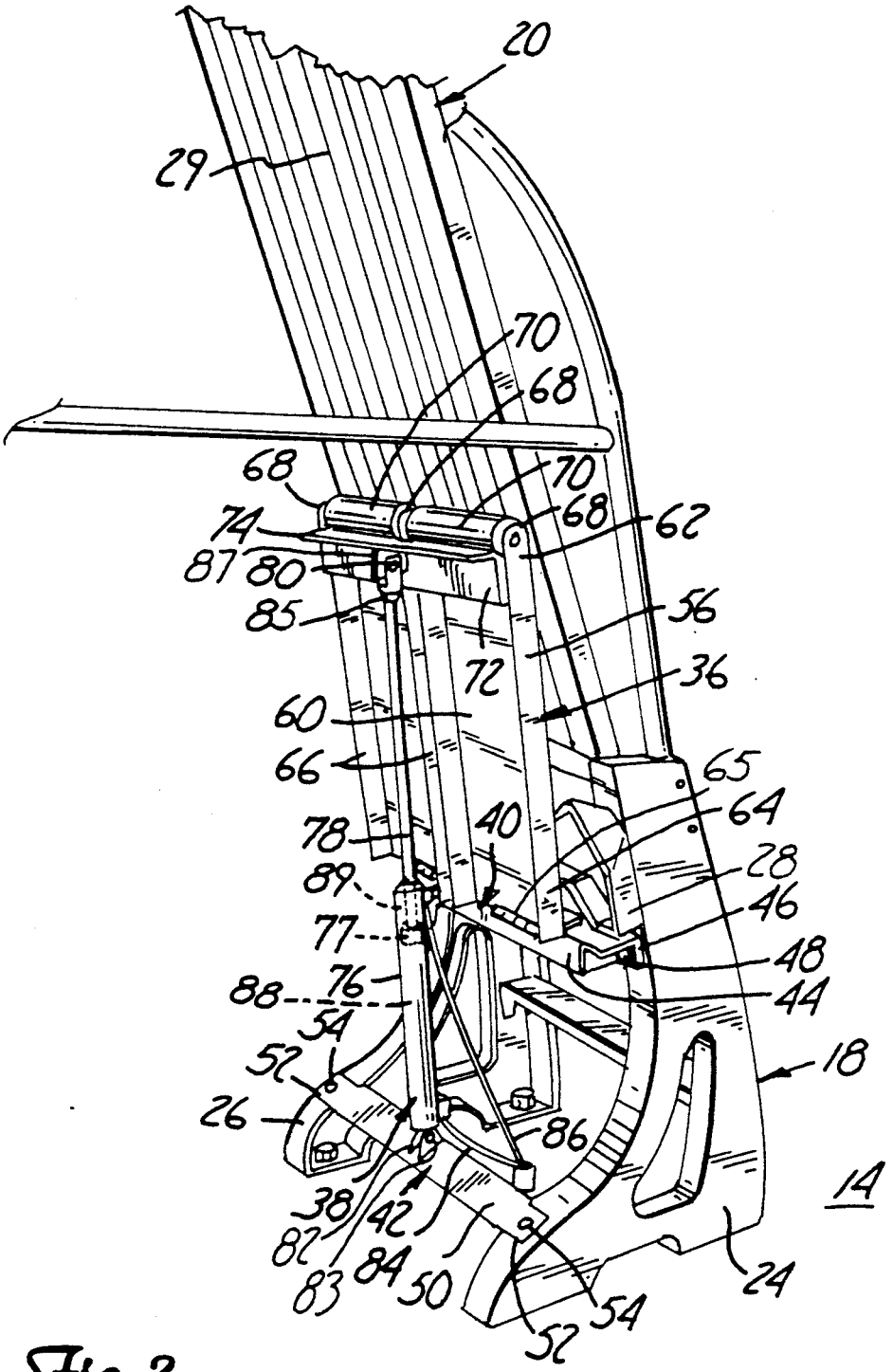
FIG. 2 illustrates a perspective view of the diving board lift assembly in accordance with the present invention.

The frame 34, in the present embodiment, includes a first structural member 40 and a second structural member 42. As illustrated in FIG. 2, the first structural member 40 includes a first structural portion 44 and a pair of mounting ears (only one shown) 46, one mounting ear 46 being integral to and extending from each end of the first structural portion 44. The first structural member 40 is positioned beneath and substantially perpendicular to the diving board 20 and directly beneath the cross member 28 such that the first structural portion 44 faces outward away from the anchored support 18. A plurality of bolts 48 secure the first structural member 40 to the anchored support 18 by extending through the mounting ears 46 into the leg members 24, 26. While the first structural member 40 is described as being attached to the anchored support 18 by a plurality of bolts 48, the first structural member 40 can also be attached by any method such as with screws or by welding or adhesives.

The second structural member 42 includes a second portion 50 and a pair of second mounting ears 52, one mounting ear 52 being integral to and extending from each end of the second portion 50. The second structural member 42 is positioned beneath and substantially perpendicular to the length of the diving board 20 and directly adjacent the floor 14 such that the second portion 50 is positioned between the leg members 24, 26 of the anchored support 18. A plurality of bolts 54 secure the second structural member 42 to the anchored support 18 by extending through the mounting ears 52 into the leg members 24, 26. The second structural member 42, like the first structural member 40, can also be attached with screws or by welding or adhesives.

While the first structural member 40 and second structural member 42 are described as being attached to the anchored support 18, it is within the scope of the present invention to only have the first structural member 40 attached to the anchored support 18 and the second structural member 42 attached to the floor 14 under the diving board 20 rather than the anchored support 18. Likewise, the frame 34 could be attached to the floor 14 rather than the anchored support 18.

The first structural member 40 and the second structural member 42 are preferably constructed of stainless steel in order to inhibit the first structural member 40 and the second structural member 42 from rusting or corroding. However, other materials besides stainless steel can also be utilized including, but not limited to, aluminum, brass and plastic.

The lifting platform 36 of the lifting assembly 10 includes a substantially planar plate 56 having a top side surface 58, as illustrated in FIG. 1, and a bottom side surface 60, as illustrated in FIG. 2. The plate 56 further includes a first end 62 and a second end 64 with the first end 62 hingedly connected to the first structural member 40 by a pair of hinges 65. A plurality of support ribs 66 are mounted on the bottom side surface 60 and extend along the length of the plate 56 from the first end 62 to the second end 64. While the ribs 66 have been illustrated as extending the entire length of the plate 56, it is within the scope of the present invention to have ribs 66 which only extend partially along the length of the plate 56.

The lifting platform 36 further includes a plurality of mounting ears 68 integral to the ribs 66 which extend beyond the second end 64 of the plate 36. A plurality of rollers 70 are provided with each roller 70 being rotatably mounted between each adjacent pair of mounting ears 68. The rollers 70 are designed and constructed to extend at least partially above the top side surface 58 of the plate 56, as illustrated in FIG. 1, to allow the rollers 70 to rotate freely along the diving board 20 without interference from the lifting platform 36, as illustrated in FIG. 2 and as will be discussed in further detail below.

The lifting platform 36 further includes a connecting member 72, which is substantially L-shaped in cross-section, attached across the ribs 66 such that the ribs 66 are between the connecting member 72 and the bottom side surface 60. An arm 74 of the L-shaped connecting member 72 protrudes downward away from the bottom side surface 60. The connecting member 72 is preferably welded to the ribs 66 but can be attached in any known fashion.

Due to the rust and corrosion inhibiting features of stainless steel, the lifting platform 36 is preferably constructed of stainless steel; the same material as the frame 34. However, other material such as aluminum, brass or plastic is also within the scope of the art.

The hydraulic cylinder 38 of the lifting assembly includes a fluid-receiving housing 76. A piston 77 is slidably mounted within the housing 76 in a fluid-tight manner. The piston 77 divides the housing into a first chamber 88 and a second chamber 89. A traveling piston rod 78 is connected to one side of the piston 77. The relationship between the housing 76 and the rod 78 is similar to any piston-type mechanism in that introduction of hydraulic fluid (not shown) into the first chamber 88 of the housing 76 causes the piston 77 to force the rod 78 out of the housing 76. Likewise, introduction of fluid into the second chamber 89 causes the piston 77 to move in the opposite direction such that the rod 78 travels back into the housing 76.

The housing 76 includes a tab portion (not shown) pivotally mounted to a bracket 82 by a pin 83. The bracket 82 is securely attached to the second structural member 42 by welding or other conventional means. A bracket 85 on the rod 78 is pivotally attached to a tab member 87 on the arm 74 of the connecting member 72 by a pin 80 of the lifting platform 36.

As illustrated in FIG. 1, the hydraulic cylinder 38 maintains the lifting platform 36 at a distance below the diving board 20 which does not interfere with the use of the diving board 20. This allows regular diving activities to continue without need for removal of the diving board lift assembly 10.

As illustrated in FIG. 2, a plurality of hydraulic fluid lines 84, 86 extend from the housing 76 of the hydraulic cylinder 38 to a hydraulic fluid source (not shown). The fluid line 84 carries the hydraulic fluid from the fluid source to the first chamber 88 of the housing 86. The fluid line 86 carries the hydraulic fluid from the fluid source to the second chamber of the housing 76. Activation mechanisms (not shown) to activate the hydraulic cylinder 38 by causing the hydraulic fluid to travel to and from the housing 76 through the fluid lines 84, 86 are preferably located remote from the diving board lift assembly 10. The activation mechanism can be any known hydraulic operating system. Positioning of the activation mechanisms remote from the diving board 20 assists in preventing non-authorized persons from activating the diving board lift assembly 10 during recreational or other diving activities.

Figure 3:
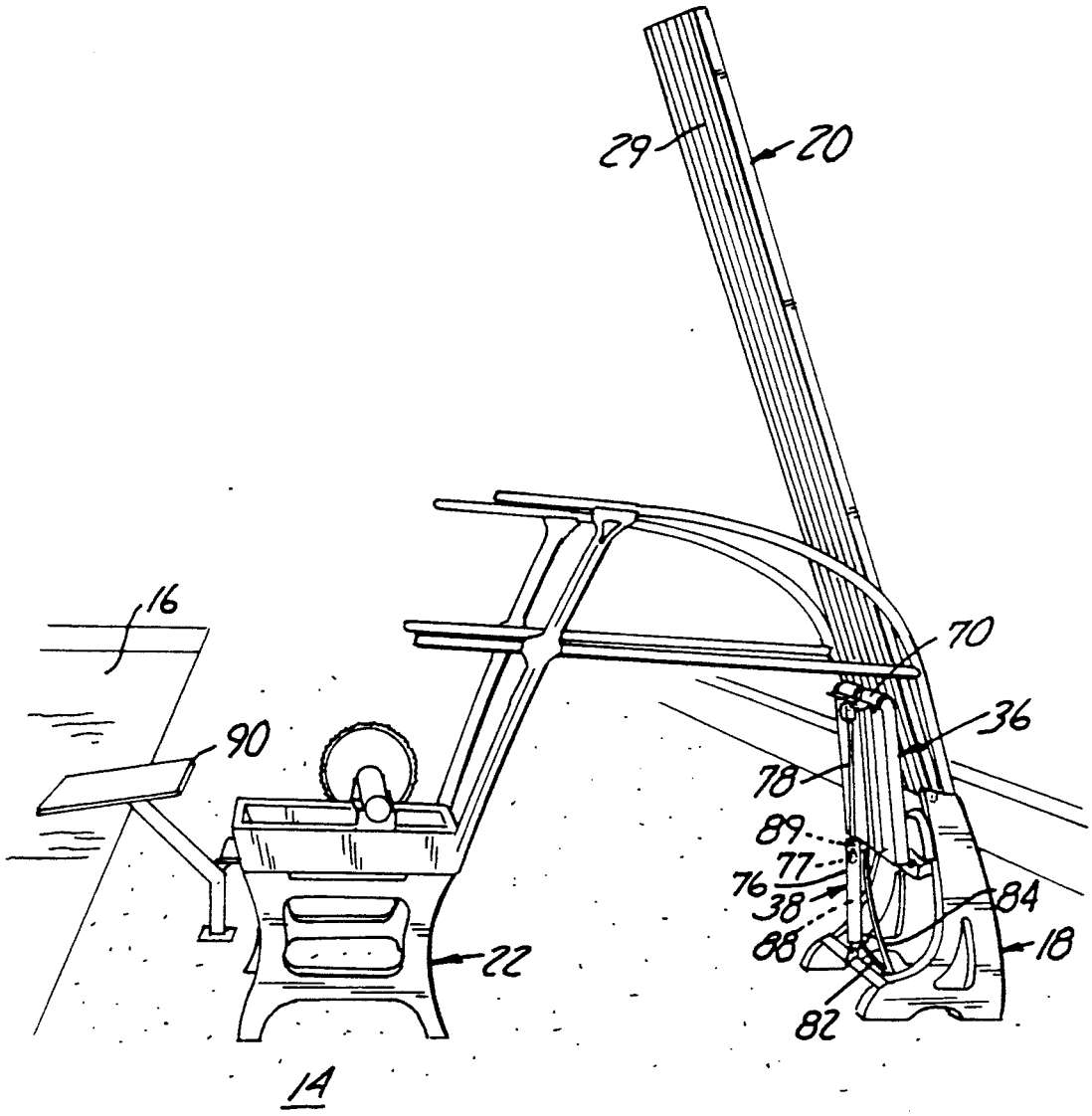
FIG. 3 illustrates a perspective view of the diving board lift assembly in accordance with the present invention with the diving board in a substantially upright position.

To operate the diving board lift assembly 10 of the present invention, the hydraulic fluid is caused to flow from the fluid source into the first chamber 88 of the housing 76 of the hydraulic cylinder 38. The piston 77 causes the rod 78 to extend thereby causing the rollers 70 of the first end 62 of the lifting platform 36 to move upward and to contact the underside 29 of the diving board 20. As additional fluid enters the housing 76, the rod 78 of the hydraulic cylinder 38 extends further causing the lifting platform 36 to lift the diving board 20 off the intermediate support 22. As the diving board 20 is being lifted, the rollers 70 roll along the underside 29 of the diving board 20. The lifting of the diving board 20 continues until, as illustrated in FIG. 3, the diving board 20 reaches a position slightly off the vertical. In a preferred embodiment, the diving board 20 and the floor 14 create an angle less than 90 degrees.

Positioning the diving board 20 slightly off the vertical allows the diving board 20 to rest against the rollers 70 without the need for additional support features. Also, with the diving board lift assembly 10 of the present invention, the diving board 20 is maintained above the floor 14 and away from any walls. Security around the swimming pool 16 has increased since the diving board 20 is not in a position which a person can strike or trip over the diving board 20.

To lower the diving board 20, the hydraulic fluid is caused to travel from the fluid source through fluid line 82 into the second chamber 89 of the housing 76. The piston 77 causes the rod 78 to retract into the housing 76 thereby lowering the lifting platform 36 and the diving board 20. As illustrated in FIG. I, the withdrawal of the hydraulic fluid from the housing 76 continues until the diving board 20 again rests on the intermediate support 22 and the lifting platform 36 is positioned a certain distance away from the diving board 20 so that it does not interfere with diving activities.

As illustrated in FIG. 3, by lifting the diving board 20 in the manner described shown and described in the present application, the diving board 20 is substantially removed from the area which racing starting blocks 90 are located. This allows swim racers to begin races without concern of striking or otherwise being injured by the diving boards.

Although the present invention has been described with reference to preferred embodiments, workers skilled in the art will recognize that changes may be made in form and detail without departing from the spirit and scope of the invention.

What is claimed is:

1. A diving board lift assembly for lifting a diving board from a substantially horizontal diving position to a substantially upright storage position, the diving board for use in connection with a swimming area, said diving board lift assembly comprising:

a frame;

a lifting platform having a first end hingedly connected to the frame such that the lifting platform is pivotable about the first end, and a second end including at least one roller rotatably mounted for contacting and rolling along the underside of the diving board while the diving board is being pivoted to the substantially upright storage position, the second end being disengaged and separated from the diving board when the diving board is in the substantially horizontal diving position; and lifting means pivotally connected to the frame and the second end of the platform for lifting the second end of the platform into contact with the diving board such that the diving board is pivoted to the substantially upright storage position.

2. The assembly of claim 1 wherein the lifting means comprises a device which lifts and lowers the second end of the platform upon introduction of fluid into the device.

3. The assembly of claim 2 wherein the device is a hydraulic cylinder having a piston driven rod attached to the second end of the lifting platform.

4. The assembly of claim 2 wherein the device is operated from a position remote from the diving board.

5. A method of lifting a diving board from a substantially horizontal diving position to a substantially upright position, the diving board being pivotally connected to an anchored support, the method comprising:

providing a lifting mechanism, the lifting mechanism contacting the diving board when the diving board is pivoted from the substantially horizontal diving position to the substantially upright position, the lifting mechanism being spaced apart from and not in contact with the diving board when the diving board is in the substantially horizontal diving position; and lifting the diving board from the substantially horizontal diving position to the substantially upright position by actuating the lifting mechanism.

6. The method of claim 6 wherein the lifting mechanism is actuated by hydraulic fluid and the method further including introducing the hydraulic fluid into the lifting mechanism to actuate the lifting mechanism.

7. A diving board and a diving board lift assembly for lifting a diving board from a substantially horizontal diving position to a substantially upright storage position comprising a frame support;

a diving board having a diving end and a mounting end pivotally to the support, the diving board being pivotable about the mounting end from a substantially horizontal diving position to a substantially vertical storage position; and a lifting mechanism for pivoting the diving board from the substantially horizontal diving position to the substantially vertical storage position, wherein the lifting mechanism is engaged with and contacts the diving board when the diving board is being pivoted from the substantially horizontal diving position to the substantially vertical storage position, and wherein the lifting mechanism is disengaged from and does not contact the diving board when the diving board is in the substantially horizontal diving position.

8. The diving board lift assembly of claim 7, wherein the lifting mechanism includes a platform having a first end hingedly connected to the support and a second end, both of the ends being positioned below the diving boards lower surface and a lift means pivotal connected to the support and the second end of the platform lifting the platform.

9. The diving board assembly of claim 8, wherein the second end of the platform includes at least one roller rotably mounted thereon for contacting and rolling along an underside of the diving board as the diving board is being lifted to the substantially vertical storage position.

* * * * *

UNITED STATES PATENT AND TRADEMARK OFFICE

CERTIFICATE OF CORRECTION

PATENT NO. : 5,326,336

DATED : July 5, 1994

INVENTOR(S) : Fredric Wemlinger

It is certified that error appears in the above-indentified patent and that said Letters Patent is hereby corrected as shown below:

Col. 6, line 66, delete "claim 6", insert --claim 5--

Col. 7, lines 3-6, delete: "7. A diving board and a diving board lift assembly for lifting a diving board from a substantially horizontal diving position to a substantially upright storage position comprising a frame support;", insert --7. A diving board and a diving board lift assembly for lifting a diving board from a substantially horizontal diving position to a substantially upright storage position comprising:

a frame support;--

Col. 8, line 10, after "platform", insert --for--

Signed and Sealed this

Third Day of January, 1995

Bruce Lehman

*Attest:*

BRUCE LEHMAN

*Attesting Officer*

*Commissioner of Patents and Trademarks*